US006418892B1

(12) United States Patent
Donce et al.

(10) Patent No.: US 6,418,892 B1
(45) Date of Patent: Jul. 16, 2002

(54) ADJUSTABLE DEVICE FOR VALVE CONTROL AND METHOD FOR ADJUSTING SAME

(75) Inventors: Lucien Donce, Magny En Vexin; Calogero Fiaccabrino, Cergy, both of (FR)

(73) Assignee: Sagem SA (FR)

( * ) Notice: Subject to any disclaimer, the term of this patent is extended or adjusted under 35 U.S.C. 154(b) by 0 days.

(21) Appl. No.: 09/959,328

(22) PCT Filed: Apr. 19, 2000

(86) PCT No.: PCT/FR00/01021

§ 371 (c)(1),
(2), (4) Date: Oct. 23, 2001

(87) PCT Pub. No.: WO00/65203

PCT Pub. Date: Nov. 2, 2000

(30) Foreign Application Priority Data

Apr. 23, 1999 (FR) ..... 99 05206

(51) Int. Cl.[7] ..... F01L 9/04

(52) U.S. Cl. ..... 123/90.11; 123/90.65; 251/129.01; 251/129.16

(58) Field of Search ..... 123/90.11, 90.65, 123/90.66, 90.67; 251/129.01, 129.1, 129.16

(56) References Cited

U.S. PATENT DOCUMENTS

| | | | | | |
|---|---|---|---|---|---|
| 5,558,054 | A | * | 9/1996 | Ariga et al. | 123/90.65 |
| 5,664,531 | A | * | 9/1997 | Kim | 123/90.65 |
| 5,782,454 | A | | 7/1998 | Bulgatz | 251/129.1 |
| 6,260,522 | B1 | * | 7/2001 | Stolk et al. | 123/90.11 |

FOREIGN PATENT DOCUMENTS

| | | |
|---|---|---|
| EP | 0 471 614 | 2/1992 |
| WO | 98 42958 | 10/1998 |

* cited by examiner

*Primary Examiner*—Weilun Lo
(74) *Attorney, Agent, or Firm*—Larson & Taylor, PLC

(57) ABSTRACT

The invention concerns a valve controlling device with linear displacement along an axis comprising a number of actuators equal to that of the valves. Each actuator has a ferromagnetic blade fixed to a valve push rod and at least a return spring whereof one end is supported against the rod and the other end is supported against fixed anchoring means, adjustable in position relative to a housing of the actuator. A passage is provided between the actuators of the two adjacent valves to allow through an adjusting tool.

13 Claims, 4 Drawing Sheets

ADJUSTABLE DEVICE FOR VALVE CONTROL AND METHOD FOR ADJUSTING SAME

The invention relates to apparatus for controlling valves in linear displacement along respective axes, the apparatus comprising as many actuators as there are valves, each actuator having an armature of ferromagnetic material secured to a valve-pusher rod and at least one return spring having one end bearing against the rod and having its opposite end bearing against stationary anchor means that are adjustable in position relative to a case of the actuator containing electromagnets for moving the armature in linear manner, adjustment of the anchor means enabling an armature rest position to be set.

Actuators of this kind can have two opposing return springs (U.S. Pat. No. 4,614,170) or a single spring working alternately in traction and in compression (French Appln No. 98/11670). They can have a single coil (U.S. patent application Ser. No. 09/806,711 corresponding to French Appln No. 98/12489 or French Appln No. 99/04472) or two coils.

The invention seeks in particular to provide valve control apparatus in which the adjustment means are compact and make it possible, once the apparatus has been mounted on the cylinder head of an engine, to make adjustments in a very short length of time.

To this end, the invention provides apparatus wherein the anchor means comprise a toothed wheel rotatable about the axis of the rod and bearing against the case, and an internally threaded spring bearing cup that is prevented from rotating with respect to the case and that has a helical connection with the toothed wheel, said spring keeping the toothed wheel in abutment bearing against the case. A passage is provided between the actuators of two adjacent valves for introduction of a rotary adjustment tool for turning the toothed wheel.

In a particular embodiment, the adjustment tool includes a toothed sector meshing with the toothed wheel. In another embodiment, a toothed sector or gearwheel meshing with the toothed wheel is permanently mounted in the case. It is designed to receive the tool. For this purpose it can have a polygonal hole or socket of a shape corresponding to the shape of the end of the tool. In this embodiment, a gearwheel or toothed sector can be provided for each of the toothed wheels. The gearwheels or toothed sectors of two adjacent actuators can be offset relative to each other in the direction that is transverse to the direction in which the actuators are in alignment so as to reduce size.

The adjustment means can thus be placed axially in register with the single or top spring without increasing the axial size of the device. Adjustment can be performed when the actuator is in place.

In an advantageous embodiment, the tapped cup is prevented from rotating by a ring interposed between the spring and the cup and having projecting lugs into the case and sliding keying means with the cup.

The invention also provides a method of adjusting apparatus of the kind defined above. In the method:

(a) an adjustment tool is inserted in each passage and the corresponding toothed sector is meshed with a respective toothed wheel;

(b) the axial rest position of the rod of each actuator is measured;

(c) the toothed wheel of each actuator is turned until the rod has been moved into a determined position relative to the cylinder head or to the case of the corresponding actuator; and (d) operations (b) and (c) are repeated after moving the tools across the passages so that their toothed sectors mesh with other toothed wheels, placed on the opposite sides of the passages.

In the first embodiment, the tool is moved laterally after being inserted to cause its toothed sector to mesh with one toothed wheel, and then with the other. In the second embodiment, it is engaged firstly in one toothed sector or gearwheel, and then in the other.

It is possible to adjust a plurality of toothed wheels simultaneously by using a plurality of tools that are inserted simultaneously and by using adjustment electronics that operates using time sharing. Nevertheless, it is generally preferable to perform adjustments successively with a single tool being inserted manually successively into the various passages, adjustment then taking place automatically with the help of electronics operating in a closed loop and put into operation under manual control.

In any event, the time required for adjusting the apparatus can be very short because adjustment can be automated by controlling the tool with the help of electronics that receives the output signal from a sensor for sensing the position of the armature, which sensor can be of the type described in French patent application No. 99/05203. It is possible to adjust half of the actuators simultaneously using electronics that operates with time sharing.

The above characteristics and others will appear more clearly on reading the following description of a particular embodiment given by way of example only.

BRIEF DESCRIPTION OF THE DRAWINGS

The description refers to the accompanying drawings, in which.

Figure 1:
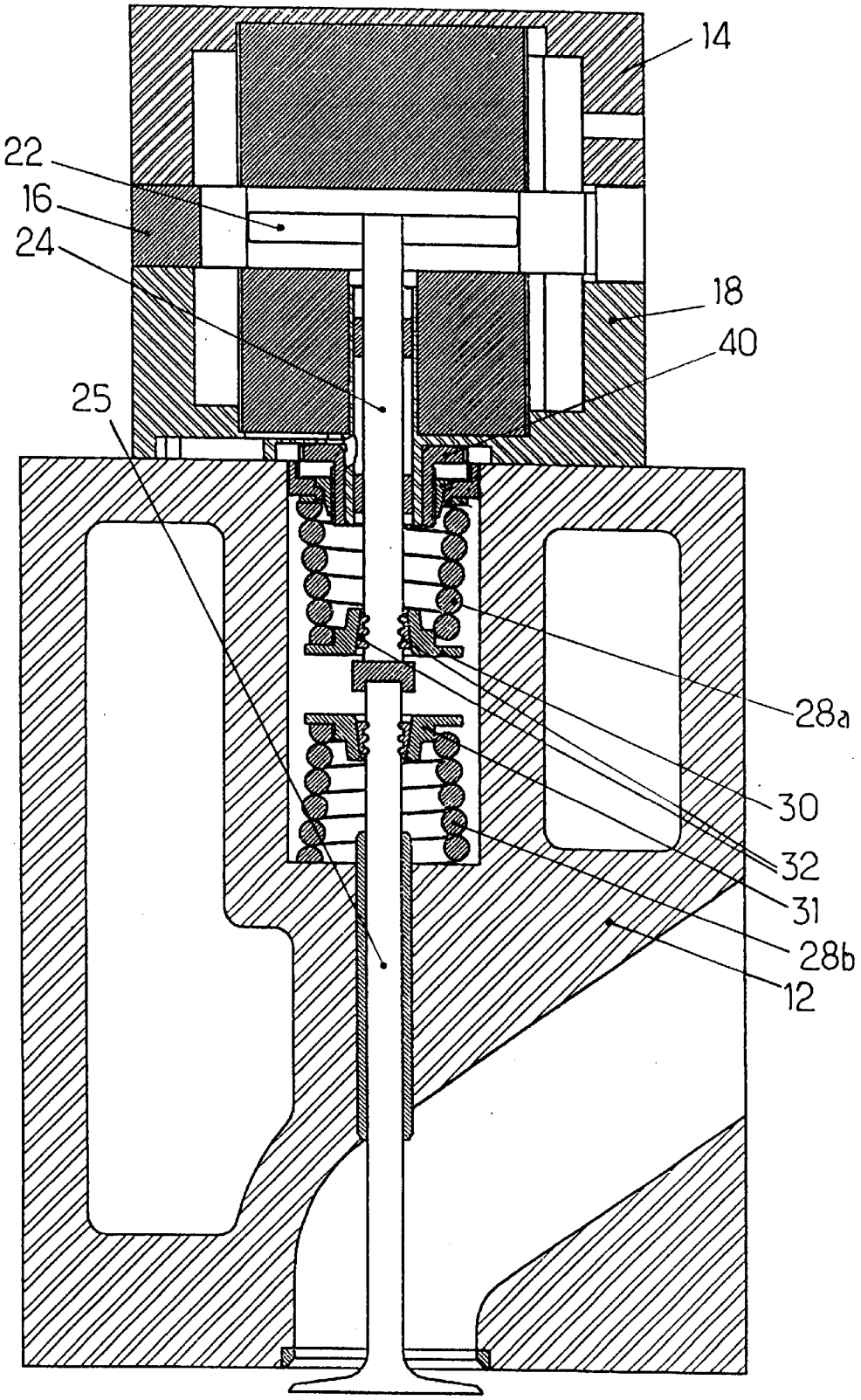
FIG. 1 is a view of the apparatus in section on a plane containing the axis of an actuator and orthogonal to the direction in which a row of actuators extends.

The apparatus of the invention is for mounting on the cylinder head 12 of an engine. By way of example, it comprises a line of eight actuators placed side by side and each controlling a respective valve. The actuator shown in FIG. 1 has a case made up of a plurality of parts 14, 16, and 18 which are stacked and assembled together by means that are not shown. These parts are made of non-ferromagnetic material, e.g. of light alloy. The case is fixed on the cylinder head 12.

The actuator comprises an armature 22 of ferromagnetic material secured to a rod 24 for driving the valve 25. In general, a plurality of valves are mounted side by side and only very little width is available for each actuator in a direction perpendicular to the plane of FIG. 1. This leads to the armature being given a rectangular shape. The armature is then prevented from turning inside the part 16, but the means whereby the rod bears against the stem of the valve allow the valve to turn.

Two return springs 28*a* and 28*b* are provided to hold the valve at rest in a position that is substantially halfway between its closed position and its fully open position. One of the springs 28*a* is compressed between adjustment means and a plate 30 secured to the rod 24 by half-rings 32. The other spring 28*b* is compressed between a plate 31 secured to the stem of the valve and the bottom of a valve well provided in the cylinder head. Distribution clearance between the raised rod and the closed valve guarantees sealing.

The actuator can also be used with a single spring working in both traction and compression i.e., exerting a tractive force and a compression force, alternatively. The actuator may have a resilient damper ensuring that the valve is has an air tight contact with its seat when closed, as described in FR-A-2 783 631, thus making it possible to implement the rod and the valve stem as a single piece. One end of the spring is then connected to the case by anchor means allowing the spring to rotate, and its other end is secured to the rod which is secured against mutual axial movement to the valve stem. The spring tends to hold the valve in or to bias it into a middle position between a closed position and a fully open position.

A first electromagnet for causing the valve to move into the closed position is placed in the part 14. It comprises a coil and a core of ferromagnetic material which is advantageously laminated.

A second electromagnet for bringing the valve into a fully open position comprises a coil and a ferromagnetic core, likewise generally laminated, that are placed in the part 18.

Like the armature, the cores are generally rectangular in shape.

In a variant, only one coil is provided.

Figure 2:
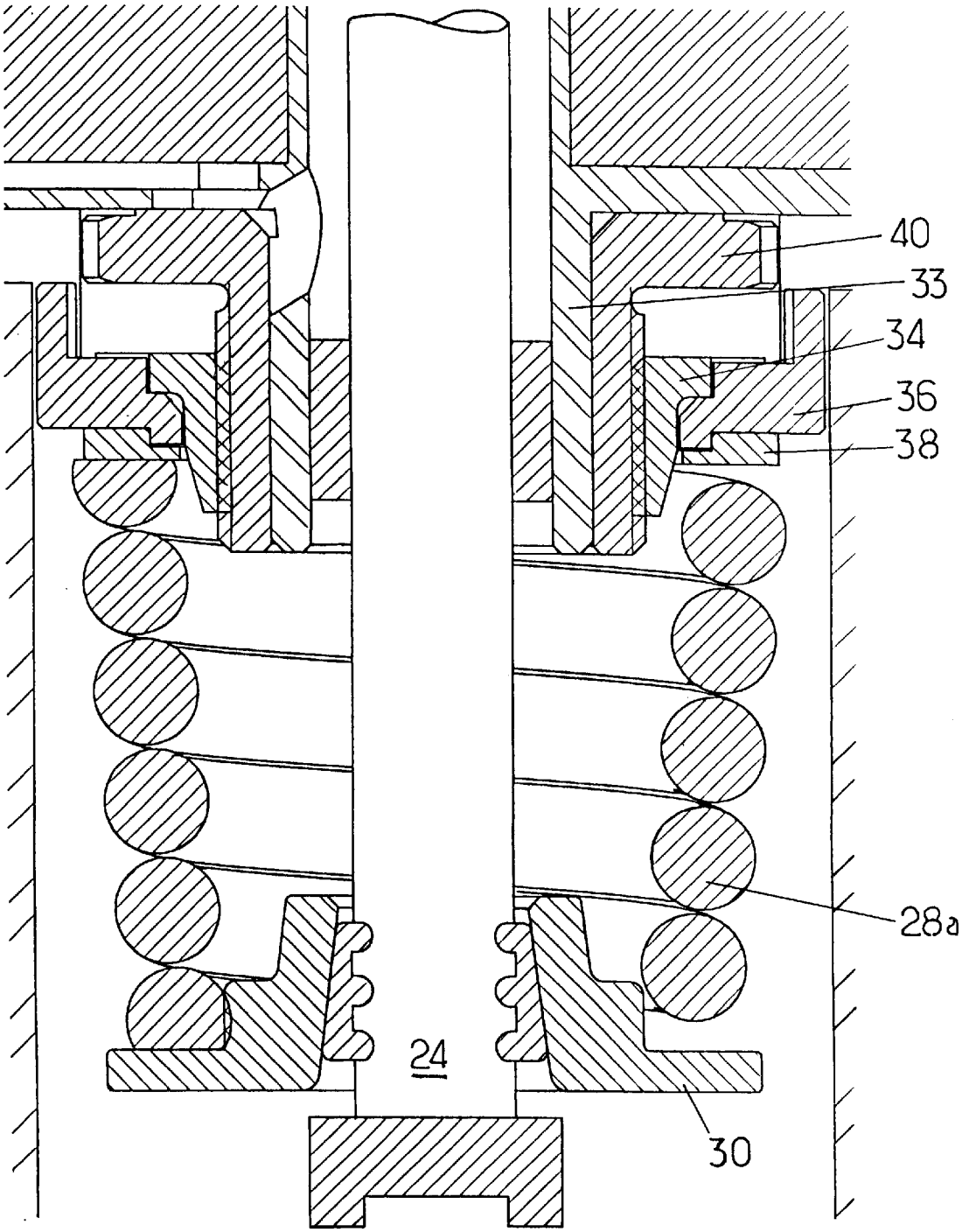
FIG. 2 is a section view through a fraction of the adjustment device, in section on a plane containing the axis of an actuator.

The adjustment means shown on a larger scale in FIG. 2 constitute anchoring or bearing means for the spring 28*a*. They comprise a toothed wheel 40 that is rotatable about the axis of the rod and that bears against the case. In the embodiment shown, the toothed wheel turns on a tubular extension or chimney 33 of the part 18. The toothed wheel 40 is extended by a threaded bottom portion onto which a tapped bearing cup 34 for the spring 28*a* is screwed. The cup is prevented from rotating relative to the case. In the embodiment shown, a ring 36 of material having a low coefficient of friction is mounted on the tapped cup 34 by sliding keying means. Lugs on the ring 36 (not shown in FIG. 2) prevent the ring from rotating relative to the case. A washer 38 transmits pressure from the spring 28*a* to the cup, and from there to the ring. This washer can be replaced by a needle bushing. The spring 28*a* thus holds the toothed wheel pressed against the case.

Assembly can then be performed as follows. The tapped cup 34 is screwed onto the toothed wheel 40. The resulting subassembly is slid onto the chimney 33. Then the ring 36, the bearing washer 38, the spring 28*a*, and its bearing plate 30 together with the two half-rings are mounted in succession. The tapped cup is prevented from rotating. The actuator is mounted on the cylinder head fitted with the valve and the spring 28*b*.

Figure 3:
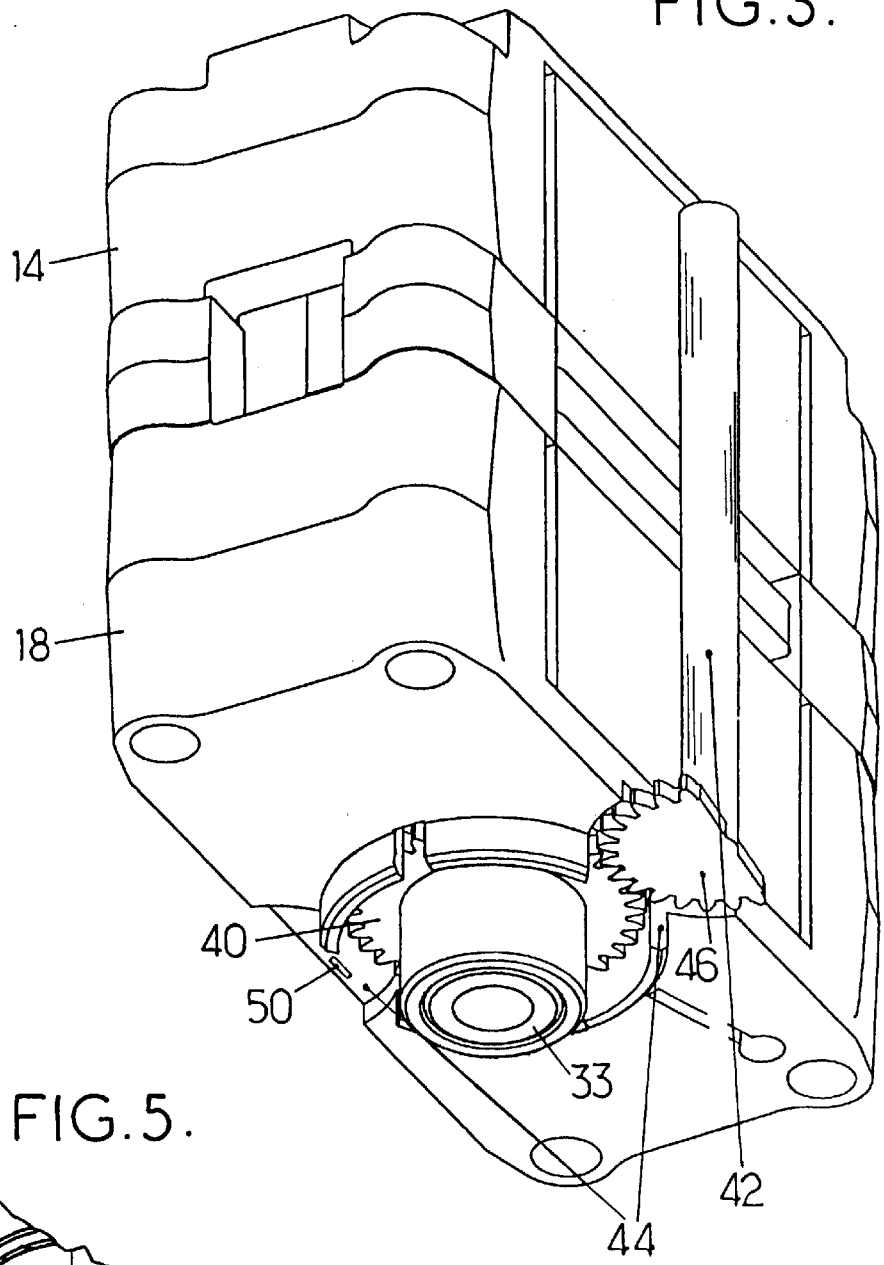
FIG. 3 is an incomplete perspective view showing the bottom face of an actuator of the apparatus.
Figure 4:
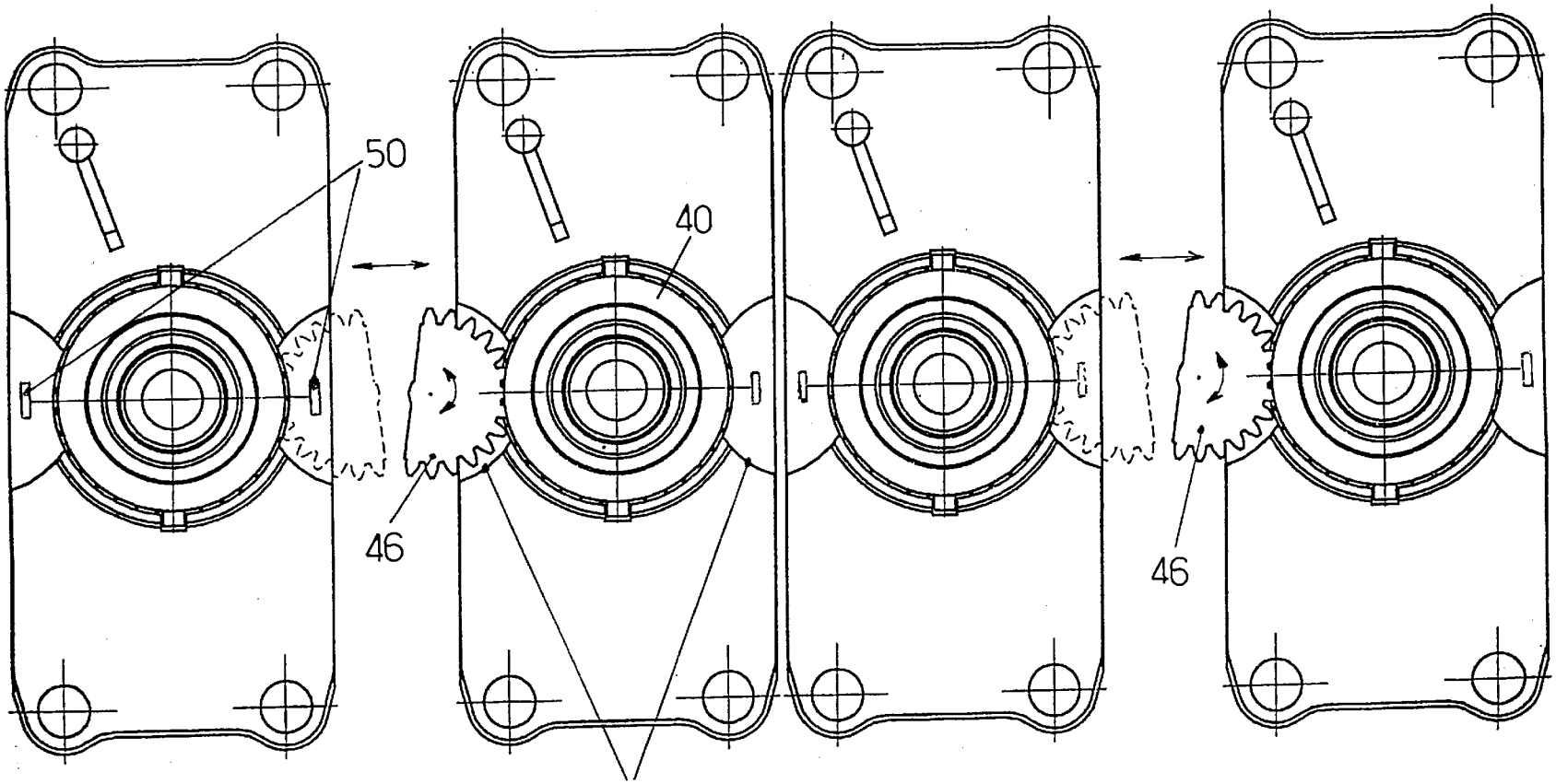
FIG. 4 is a view from beneath of a set of four actuators, showing how the toothed sectors mesh with the toothed wheels.

Once all of the actuators are in position, the apparatus is adjusted by adjusting a plurality of actuators either simultaneously, or else in succession. For this purpose, a tool 42 is used which is inserted between two adjacent actuators in the gap between two cylinders, and then into a passage defined by two facing recesses 44 of semicircular section that are formed in the part 18 and the two sides of the case (FIG. 4). In the example shown in FIG. 3, the tool is terminated by a toothed sector 46 for meshing with the toothed wheel. The tool is inserted between two actuators and is then moved sideways. Thereafter it is turned until it has brought the moving equipment into a reference position. To detect the instantaneous position of the moving equipment, the actuator is provided with a sensor such as a Hall-effect sensor of the kind described in French patent application No. 98/12940 (FR-A-2 784 712).

Figure 5:
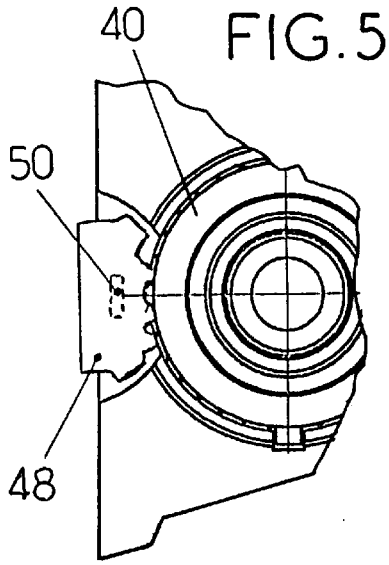
FIG. 5 is a detail view from beneath showing a pawl for locking a toothed wheel.

Once adjustment has been performed, the tapped cup 34 can be prevented from moving. For this purpose, a resilient pawl 48 (FIG. 5) is placed in a recess of the case and is provided with teeth for meshing with the toothed wheel. After adjustment, the pawl is locked in place by deforming a lug of the pawl into a notch 50 of the part 18. This deformation is reversible if it is desired to be able to perform readjustment.

As mentioned above, an adjustment bench can have a plurality of tools that are inserted simultaneously into the apparatus, e.g. five tools for apparatus controlling a row of valves in a sixteen-valve engine. Under such circumstances, as shown in FIG. 4, the tools are brought initially into the position shown by continuous lines. Four actuators are adjusted simultaneously, using a tool control circuit that operates as a closed loop with time sharing, or successively, and without requiring any intervention from an operator. Then the tools are moved into the position shown by dashed lines and the other four actuators are adjusted.

In a variant, only one tool is provided and it is engaged manually in succession into all five passages.

In yet another variant (not shown), a toothed sector or gearwheel meshing with the toothed wheel is permanently mounted in the case of each actuator and is designed to receive the tool. The toothed sector or gearwheel has a polygonal socket or hole of a shape that corresponds to the shape of the end of a suitable tool, with one gearwheel or toothed sector being provided for each toothed wheel. The toothed sectors or gearwheels or two adjacent actuators are offset relative to each other in a direction extending transversely to the direction in which the actuators are aligned so as to prevent them interfering.

In yet another modified embodiment, the actuators of two adjacent valves belonging to the same engine cylinder are combined as a single block (French patent application No. 99/04472). Then each passage serves two actuators and is in a same block. To perform each adjustment, the tool engages and drives an appropriate intermediate gearwheel.

What is claimed is:

1. Apparatus for controlling a plurality of engine valves arranged for reciprocating movement along mutually parallel respective axes, the apparatus comprising as many actuators as there are valves, each actuator having:

an armature of ferromagnetic material secured to a valve push-rod, at least one return spring having one end bearing against the push-rod and having its opposite end bearing against stationary anchor means that are adjustable in position relative to a case of the actuator, electromagnet means in the case for moving the armature in linearly along the axis of the respective valve , whereby adjustment of the anchor means in the direction of the reciprocating movement enables to set a rest position of said armature, wherein the anchor means comprise a toothed wheel rotatable about the axis of a respective one of said push-rods and in abutment against the case, and a spring bearing cup that is prevented from rotating and that has a helical connection with the respective toothed wheel, said spring for forcing the toothed wheel into contact with the case and wherein passage means are provided parallel to said axes to pass a rotary adjustment tool for turning the toothed wheel of the respective actuator.

2. Adjustment apparatus according to claim 1, wherein the tool has a toothed sector for meshing with the toothed wheel.

3. Adjustment apparatus according to claim 1, further comprising a toothed sector or gearwheel meshing with the toothed wheel, permanently mounted in the case and arranged to receive the tool.

4. Adjustment apparatus according to claim 3, wherein the toothed sector or gearwheel has a polygonal recess or hole of cross-sectional shape corresponding to a shape of an end of the tool, one gearwheel or toothed sector being provided for each toothed wheel.

5. Adjustment apparatus according to claim 3, wherein the toothed sectors or gearwheels of two adjacent ones of said actuators are offset relative to each other in a direction extending transversely to a direction along which the actuators are in alignment.

6. Adjustment apparatus according to claim 1, wherein the cup is prevented from rotating by a ring interposed between the spring and the cup, the ring having lugs projecting into the case and sliding keying means engaging the cup.

7. Adjustment apparatus according to claim 6, further comprising a bearing washer or a needle bushing interposed between the spring and the ring.

8. Adjustment apparatus according to claim 1, wherein said passage means comprise a plurality of passages each provided between the actuators of two mutually adjacent valves.

9. Adjustment apparatus according to claim 1, wherein each of said actuators has two springs, one of which is compressed between the cup and a member secured to the rod, and the other of which is compressed between the cylinder head of an engine having the valves and the stem of the valve so as to bias the valve to a closed condition.

10. Adjustment apparatus according to claim 1, wherein each of said actuators comprises a single spring having one end secured to the case by said anchor means that are arranged to allow the spring to rotate and having its other end fixed to the push-rod and wherein the push-rod is provided with means for preventing mutual axial movement of said push-rod and the stem of the respective valve, said spring biasing the valve toward an intermediate position between a closed position and a fully open position of said valve.

11. Adjustment apparatus according to claim 1, wherein each of said actuators has a single coil.

12. A method of adjusting apparatus for controlling a plurality of valves of an internal combustion engine, all said valves being arranged for reciprocating movement along mutually parallel respective axes, the apparatus comprising as many actuators as there are valves and each actuator having:

an armature of ferromagnetic material secured to a valve push-rod, at least one return spring having one end bearing against the push-rod and having its opposite end bearing against stationary anchor means that are adjustable in position relative to a case of the actuator, said anchor means comprising a plurality of toothed wheels each rotatable about the axis of a respective one of said push-rods and a spring bearing cup that is prevented from rotating and has a helical connection with one of said toothed wheels electromagnet means in the case for moving the armature in linearly along the axis of the respective valve, comprising the steps of:

(a) inserting an adjustment tool into a passage formed in the apparatus and meshing a toothed sector of the tool with a respective one of said toothed wheel;

(b) measuring the axial position of the rod of each actuator at rest;

(c) turning the toothed wheel of said actuator until the rod has been moved into a determined position relative to the cylinder head or to the case of the respective actuator; and (d) repeating operations (a), (b) and (c) after moving the tool.

13. A method according to claim 12, wherein the tool is moved transversely across the passage so that its toothed sector successively meshes with two different toothed wheels, placed on opposite sides of the passage.

* * * * *